US007681883B2

(12) United States Patent
DeGruchy

(10) Patent No.: US 7,681,883 B2
(45) Date of Patent: Mar. 23, 2010

(54) DIVERTER ASSEMBLY, PRINTING SYSTEM AND METHOD

(75) Inventor: Paul J. DeGruchy, Hilton, NY (US)

(73) Assignee: Xerox Corporation, Norfolk, CT (US)

( * ) Notice: Subject to any disclaimer, the term of this patent is extended or adjusted under 35 U.S.C. 154(b) by 276 days.

(21) Appl. No.: 11/417,411

(22) Filed: May 4, 2006

(65) Prior Publication Data

US 2007/0257426 A1 Nov. 8, 2007

(51) Int. Cl.
*B65H 39/10* (2006.01)

(52) U.S. Cl. ..... 271/298; 271/303

(58) Field of Classification Search ..... 271/298, 271/303; 198/440, 441, 608, 612
See application file for complete search history.

(56) References Cited

U.S. PATENT DOCUMENTS 3,391,777 A * 7/1968 Joa ..... 198/418.4
4,373,713 A * 2/1983 Loebach ..... 271/303
4,579,446 A 4/1986 Fujino et al.
4,587,532 A 5/1986 Asano
4,729,282 A * 3/1988 Kasdorf ..... 83/26
4,836,119 A 6/1989 Siraco et al.
4,930,383 A * 6/1990 Kobler ..... 83/27
5,004,222 A 4/1991 Dobashi
5,008,713 A 4/1991 Ozawa et al.
5,029,842 A * 7/1991 Belanger et al. ..... 271/188
5,080,340 A 1/1992 Hacknauer et al.
5,095,342 A 3/1992 Farrell et al.
5,159,395 A 10/1992 Farrell et al.
5,208,640 A 5/1993 Horie et al.
5,272,511 A 12/1993 Conrad et al.
5,326,093 A 7/1994 Sollitt
5,435,544 A 7/1995 Mandel
5,473,419 A 12/1995 Russel et al.
5,489,969 A 2/1996 Soler et al.
5,504,568 A 4/1996 Saraswat et al.
5,525,031 A 6/1996 Fox
5,557,367 A 9/1996 Yang et al.
5,568,246 A 10/1996 Keller et al.
5,570,172 A 10/1996 Acquaviva
5,596,416 A 1/1997 Barry et al.
5,629,762 A 5/1997 Mahoney et al.
5,702,100 A * 12/1997 Novick et al. ..... 271/302
5,710,968 A 1/1998 Clark et al.
5,778,377 A 7/1998 Marlin et al.
5,884,910 A 3/1999 Mandel
5,995,721 A 11/1999 Rourke et al.
6,059,284 A 5/2000 Wolf et al.

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Patrick H Mackey
*Assistant Examiner*—Michael C McCullough
(74) *Attorney, Agent, or Firm*—Fay Sharpe LLP

(57) ABSTRACT

A diverter assembly includes at least one rotary member disposed along a media transport pathway adjacent a diversion point therealong. The diverter assembly also includes a rotational motion source in operative association with the at least one rotary member. A printing system includes a diverter assembly. A method of transporting sheet media includes utilizing a diverter assembly.

22 Claims, 5 Drawing Sheets

U.S. PATENT DOCUMENTS

| | | | | |
|---|---|---|---|---|
| 6,116,595 | A * | 9/2000 | d'Agrella et al. | 271/279 |
| 6,125,248 | A | 9/2000 | Moser | |
| 6,129,352 | A * | 10/2000 | Stab | 271/302 |
| 6,158,736 | A * | 12/2000 | Bergeron | 271/303 |
| 6,241,242 | B1 | 6/2001 | Munro | |
| 6,244,593 | B1 * | 6/2001 | Schaefer et al. | 271/270 |
| 6,254,093 | B1 * | 7/2001 | d'Agrella et al. | 271/279 |
| 6,297,886 | B1 | 10/2001 | Cornell | |
| 6,302,392 | B1 * | 10/2001 | Schaefer et al. | 271/283 |
| 6,321,902 | B1 * | 11/2001 | Stab | 198/644 |
| 6,341,773 | B1 | 1/2002 | Aprato et al. | |
| 6,384,918 | B1 | 5/2002 | Hubble, III et al. | |
| 6,394,445 | B1 * | 5/2002 | d'Agrella et al. | 271/182 |
| 6,450,711 | B1 | 9/2002 | Conrow | |
| 6,476,376 | B1 | 11/2002 | Biegelsen et al. | |
| 6,476,923 | B1 | 11/2002 | Cornell | |
| 6,493,098 | B1 | 12/2002 | Cornell | |
| 6,537,910 | B1 | 3/2003 | Burke et al. | |
| 6,550,762 | B2 | 4/2003 | Stoll | |
| 6,554,276 | B2 | 4/2003 | Jackson et al. | |
| 6,572,097 | B2 * | 6/2003 | d'Agrella et al. | 271/182 |
| 6,572,098 | B2 * | 6/2003 | Schaefer et al. | 271/186 |
| 6,577,925 | B1 | 6/2003 | Fromherz | |
| 6,607,320 | B2 | 8/2003 | Bobrow et al. | |
| 6,608,988 | B2 | 8/2003 | Conrow | |
| 6,612,566 | B2 | 9/2003 | Stoll | |
| 6,612,571 | B2 | 9/2003 | Rider | |
| 6,621,576 | B2 | 9/2003 | Tandon et al. | |
| 6,633,382 | B2 | 10/2003 | Hubble, III et al. | |
| 6,639,669 | B2 | 10/2003 | Hubble, III et al. | |
| 6,819,906 | B1 | 11/2004 | Herrmann et al. | |
| 6,925,283 | B1 | 8/2005 | Mandel et al. | |
| 6,959,165 | B2 | 10/2005 | Mandel et al. | |
| 6,973,286 | B2 | 12/2005 | Mandel et al. | |
| 7,024,152 | B2 | 4/2006 | Lofthus et al. | |
| 7,121,201 | B2 * | 10/2006 | Landskron et al. | 101/232 |
| 2002/0078012 | A1 | 6/2002 | Ryan et al. | |
| 2002/0103559 | A1 | 8/2002 | Gartstein | |
| 2003/0077095 | A1 | 4/2003 | Conrow | |
| 2003/0234487 | A1 * | 12/2003 | Tamura et al. | 271/303 |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0120745 | A1 * | 6/2004 | Yamakawa et al. | 399/407 |
| 2004/0150156 | A1 | 8/2004 | Fromherz et al. | |
| 2004/0150158 | A1 | 8/2004 | Biegelsen et al. | |
| 2004/0153983 | A1 | 8/2004 | McMillan | |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1 | 12/2004 | Lofthus et al. | |
| 2006/0033771 | A1 | 2/2006 | Lofthus et al. | |
| 2006/0039728 | A1 | 2/2006 | deJong et al. | |
| 2006/0066885 | A1 | 3/2006 | Anderson et al. | |
| 2006/0067756 | A1 | 3/2006 | Anderson et al. | |
| 2006/0067757 | A1 | 3/2006 | Anderson et al. | |

OTHER PUBLICATIONS

Desmond Fretz, "Cluster Printing Solution Announced", Today at Xerox (TAX), No. 1129, Aug. 3, 2001.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/170,873, filed Jun. 30, 2005, Klassen.
U.S. Appl. No. 11/170,975, filed Jun. 30, 2005, Klassen.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/212,367, filed Aug. 26, 2005, Anderson et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/287,177, filed Nov. 23, 2005, Mandel et al.
U.S. Appl. No. 11/291,583, filed Nov. 30, 2005, Lang.
U.S. Appl. No. 11/291,860, filed Nov. 30, 2005, Willis.
U.S. Appl. No. 11/274,638, filed Nov. 15, 2005, Wu et al.
U.S. Appl. No. 11/287,685, filed Nov. 28, 2005, Carolan.
U.S. Appl. No. 11/317,589, filed Dec. 23, 2005, Biegelsen et al.
U.S. Appl. No. 11/314,774, filed Dec. 21, 2005, Klassen.
U.S. Appl. No. 11/317,167, filed Dec. 23, 2005, Lofthus et al.
U.S. Appl. No. 11/314,828, filed Dec. 21, 2005, Anderson et al.
U.S. Appl. No. 11/292,388, filed Nov. 30, 2005, Mueller.
U.S. Appl. No. 11/292,163, filed Nov. 30, 2005, Mandel et al.
U.S. Appl. No. 11/312,081, filed Dec. 20, 2005, Mandel et al.
U.S. Appl. No. 11/331,627, filed Jan. 13, 2006, Moore.
U.S. Appl. No. 11/341,733, filed Jan. 27, 2006, German.
U.S. Appl. No. 11/359,065, filed Feb. 22, 2005, Banton.
U.S. Appl. No. 11/349,828, filed Feb. 8, 2006, Banton.
U.S. Appl. No. 11/364,685, filed Feb. 28, 2006, Hindi et al.
U.S. Appl. No. 11/363,378, filed Feb. 27, 2006, Anderson et al.
U.S. Appl. No. 11/378,046, filed Mar. 17, 2006, Rizzolo et al.
U.S. Appl. No. 11/378,040, filed Mar. 17, 2006, German.
U.S. Appl. No. 11/403,785, filed Apr. 13, 2006, Banton et al.
U.S. Appl. No. 11/399,100, filed Apr. 6, 2006, Paul.

* cited by examiner

DIVERTER ASSEMBLY, PRINTING SYSTEM AND METHOD

BACKGROUND

The present disclosure broadly relates to the art of printing systems and, more particularly, to at least a diverter assembly, a printing system including a diverter assembly, and a method of transporting sheet media.

Known printing systems commonly include two or more media transport paths that divert from one another at certain points and join one another at other points. Thus, a given sheet of media can normally be transported through a known printing system along any one of a variety of transport paths.

One example of printing systems in which such various transport paths are utilized are those printing systems having multiple marking engines. In such printing systems, sheets of media are selectively transported from a media supply to one of two or more marking engines. Thus, a diversion point is provided along the transport pathway at which one or more sheets of media will be directed toward one of the two or more marking engines.

Upon reaching the diversion point, a sheet of media will not itself select the appropriate media transport path along which movement of the sheet is desired. As such, mechanical diverters are typically provided immediately in front of the divergent transport paths to deflect the sheet along the desired pathway. One example of such a known mechanical diverter includes a gate that extends across the media transport path immediately in front of the diversion point of the transport path. The gate includes an upstream edge and a downstream edge, and is oriented along the transport path such that the downstream edge is pivotally supported at approximately the diversion point of the transport pathway. Thus, the gate creates a diagonally-extending blockage across the pathway that displaceable between first and second positions corresponding to sheet media diversion along the first and second transport paths.

In the first gate position, the leading edge of the gate is stationed away from or opposite the direction of the first transport pathway (e.g., stationed along the bottom of a horizontal transport path for diversion along an upwardly directed pathway), which thereby exposes a first side or surface of the gate. An incoming sheet of media will pass by the leading edge of the gate and contact the first side thereof, which will direct the sheet into and along the first transport path. In the second gate position, the leading edge of the gate is stationed away from or opposite the direction of the second transport path (e.g., stationed along the top of a horizontal transport path for diversion along a downward-directed pathway), which thereby exposes an opposing second side or surface of the gate. An incoming sheet of media will pass by the leading edge of the gate and contact the second side thereof, which in turn directs the sheet into and along the second transport path.

In operation, a printing system will transport sheets along the media transport pathway and frequently shift the gate between the first and second gate positions to selectively direct the transported sheets along an appropriate one of the first and second pathways. Commonly, a linear actuator, such as a spring-based solenoid, for example, will be operatively associated with the gate to switch the same between the first and second gate positions. One difficulty with such known arrangements, however, is associated with the continued demand for and corresponding advancement of the performance of printing systems (e.g., increased output in pages per minute). As the number of sheets transported through the pathways of a printing system increase, the number of corresponding gate switching operations is typically also increased. Thus, undesirable occurrences, such as impacts, vibrations and/or noise levels, for example, may become elevated due, at least in part, to these more frequent gate switching operations.

Another difficulty with known gate arrangements, which is also associated with the advancing performance of printing systems, involves the timing between the passing of a first sheet of media, the movement of the gate to a different position, and the arrival of a second sheet of media. More specifically, a given printing system will operate using a predetermined inter-document gap (IDG), which generally refers to the spacing between the trailing edge of a first sheet of media and the leading edge of a second sheet of media. However, as the output performance of printing systems continues to be improved, increasingly smaller inter-sheet gaps are expected to be used.

It is well known that the arrival of a second sheet of media at a diversion point prior to a gate reaching a desired gate position could result in the leading edge of the sheet of material contacting the upstream edge of the gate and thereby creating a jam or other undesirable condition. It will be recognized, them that as increasingly smaller IDGs are used, the time available for the gate to move from one position to the other is reduced. As such, the operating speed of the gate can be increased to maintain the desired operating. However, it is expected that a practical performance threshold will be eventually reached, above which only marginal increases gate switching speeds will be achievable using practical gate configurations (e.g., mechanisms of practical size or having a reasonable cost relative to the price point of the printing system).

One technique that can be used to increase the performance of known gate mechanisms involves initiating the switch between gate positions prior to the trailing edge of the first sheet clearing the upstream edge of the gate. However, while such techniques seem to work well at known printing system performance levels, as sheet media speeds increase and IDGs are reduced, the window for initiating the gate switch is reduced, Furthermore, care is normally exercised to ensure that that the upstream edge of the gate does not pinch or otherwise engage the first sheet of media, such as along the trailing edge thereof, and thereby undesirably slow or disrupt the movement of the sheet, This may be of particular concern where an advancement in the timing of the gate switching operations is being used to increase performance of the printing system.

Accordingly, it is believed desirable to develop a diverter assembly, printing system and method that overcomes the foregoing and other problems and difficulties.

CROSS REFERENCE TO RELATED PATENTS AND APPLICATIONS

The following patents/applications, the disclosures of each being totally incorporated herein by reference are mentioned:

Application Ser. No. 11/212,367, filed Aug. 26, 2005, entitled "PRINTING SYSTEM," by David G. Anderson, et al., and claiming priority to U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES";

U.S. Publication No. US-2006-0067756-A1 filed Sep. 27, 2005, entitled "PRINTING SYSTEM," by David G. Anderson, et al., and claiming priority to U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE," and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE";

U.S. Publication No. US-2006-0067757-A1, filed Sep. 27, 2005, entitled "PRINTING SYSTEM," by David G. Anderson, et al., and claiming priority to U.S. Provisional Patent Application Ser. No. 60/631,918, Filed Nov. 30, 2004, entitled "PRINTING SYSTEM WITH MULTIPLE OPERATIONS FOR FINAL APPEARANCE AND PERMANENCE," and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE";

U.S. Pat. No. 6,973,286, issued Dec. 6, 2005, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. Application No. US-2006-0012102-A1, published Jan. 19, 2006, entitled "FLEXIBLE PAPER PATH USING MULTIDIRECTIONAL PATH MODULES," by Daniel G. Bobrow;

U.S. Publication No. US-2006-0033771-A1, published Feb. 16, 2006, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. Pat. No. 7,924,152, issued Apr. 4, 2006, entitled "PRINTING SYSTEM WITH HORIZONTAL HIGHWAY AND SINGLE PASS DUPLEX," by Robert M. Lofthus, et al.;

U.S. Publication No. US-2006-0039728-A1, published Feb. 23, 2006, entitled "PRINTING SYSTEM WITH INVERTER DISPOSED FOR MEDIA VELOCITY BUFFERING AND REGISTRATION," by Joannes N. M. deJong, et al.;

U.S. Publication No. US-2006-0039729-A1, published Feb. 23, 2006, entitled "PARALLEL PRINTING ARCHITECTURE USING IMAGE MARKING ENGINE MODULES (as amended)," by Barry P. Mandel, et al.;

U.S. Pat. No. 6,959,165, issued Oct. 25, 2005, entitled "HIGH RATE PRINT MERGING AND FINISHING SYSTEM FOR PARALLEL PRINTING," by Barry P. Mandel, et al.;

U.S. application Ser. No. 10/933,556, filed Sep. 3, 2004, entitled "SUBSTRATE INVERTER SYSTEMS AND METHODS," by Stan A. Spencer, et al.;

U.S. application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski, et al.;

U.S. application Ser. No. 11/000,168, filed Nov. 30, 2004, entitled "ADDRESSABLE FUSING AND HEATING METHODS AND APPARATUS," by David K. Biegelsen, et al.;

U.S. Pat. No. 6,925,283, issued Aug. 2, 2005, entitled "HIGH PRINT RATE MERGING AND FINISHING SYSTEM FOR PARALLEL PRINTING," by Barry P. Mandel, et al.;

U.S. application Ser. No. 11/051,817, filed Feb. 4, 2005, entitled "PRINTING SYSTEMS," by Steven R. Moore, et al.;

U.S. application Ser. No. 11/089,854, filed Mar. 25, 2005, entitled "SHEET REGISTRATION WITHIN A MEDIA INVERTER," by Robert A. Clark, et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/093,229, filed Mar. 29, 2005, entitled "PRINTING SYSTEM," by Paul C. Julien;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/109,566, filed Apr. 19, 2005, entitled "MEDIA TRANSPORT SYSTEM," by Barry P. Mandel, et al.;

U.S. application Ser. No. 11/166,581, filed Jun. 24, 2005, entitled "MIXED OUTPUT PRINT CONTROL METHOD AND SYSTEM," by Joseph H. Lang, et al.;

U.S. application Ser. No. 11/166,299, filed Jun. 24, 2005, entitled "PRINTING SYSTEM," by Steven R. Moore;

U.S. application Ser. No. 11/208,871, filed Aug. 22, 2005, entitled "MODULAR MARKING ARCHITECTURE FOR WIDE MEDIA PRINTING PLATFORM," by Edul N. Dalal, et al.;

U.S. application Ser. No. 11/215,791, filed Aug. 30, 2005, entitled "CONSUMABLE SELECTION IN A PRINTING SYSTEM," by Eric Hamby, et al.;

U.S. application Ser. No. 11/234,468, filed Sep. 23, 2005, entitled "PRINTING SYSTEM," by Eric Hamby, et al.;

U.S. application Ser. No. 11/247,778, filed Oct. 11, 2005, entitled "PRINTING SYSTEM WITH BALANCED CONSUMABLE USAGE," by Charles Radulski, et al.;

U.S. application Ser. No. 11/248,044, filed Oct. 12, 2005, entitled "MEDIA PATH CROSSOVER FOR PRINTING SYSTEM," by Stan A. Spencer, et al.; and U.S. application Ser. No. 11/287,177, filed Nov. 23, 2005, entitled "MEDIA PASS THROUGH MODE FOR MULTI-ENGINE SYSTEM," by Barry P. Mandel, et al.;

U.S. application Ser. No. 11/287,685, filed Nov. 28, 2005, entitled "MULTIPLE IOT PPHOTORECEPTOR BELT SEAM SYNCHRONIZATION," by Kevin M. Carolan;

U.S. application Ser. No. 11/291,860, filed Nov. 30, 2005, entitled "MEDIA PATH CROSSOVER CLEARANCE FOR PRINTING SYSTEM," by Keith L. Willis;

U.S. application Ser. No. 11/292,388, filed Nov. 30, 2005, entitled "PRINTING SYSTEM," by David A. Mueller;

U.S. application Ser. No. 11/291,583, filed Nov. 30, 2005, entitled "MIXED OUTPUT PRINTING SYSTEM," by Joseph H. Lang;

U.S. application Ser. No. 11/312,081, filed Dec. 20, 2005, entitled "PRINTING SYSTEM ARCHITECTURE WITH CENTER CROSS-OVER AND INTERPOSER BY-PASS PATH," by Barry P. Mandel, et al.;

U.S. application Ser. No. 11/314,828, filed Dec. 21, 2005, entitled "MEDIA PATH DIAGNOSTICS WITH HYPER MODULE ELEMENTS," by David G. Anderson, et al;

U.S. application Ser. No. 11/317,589, filed Dec. 23, 2005, entitled "UNIVERSAL VARIABLE PITCH INTERFACE INTERCONNECTING FIXED PITCH SHEET PROCESSING MACHINES," by David K. Biegelsen, et al.;

U.S. application Ser. No. 11/317,167, filed Dec. 23, 2005, entitled "PRINTING SYSTEM," by Robert M. Lofthus, et al.;

U.S. application Ser. No. 11/331,627, filed Jan. 13, 2006, entitled "PRINTING SYSTEM INVERTER APPARATUS", by Steven R. Moore;

U.S. application Ser. No. 11/341,733, filed Jan. 27, 2006, entitled "PRINTING SYSTEM AND BOTTLENECK OBVIATION", by Kristine A. German;

U.S. application Ser. No. 11/349,828, filed Feb. 8, 2005, entitled "MULTI-DEVELOPMENT SYSTEM PRINT ENGINE", by Martin E. Banton;

U.S. application Ser. No. 11/359,065, filed Feb. 22, 2005, entitled "MULTI-MARKING ENGINE PRINTING PLATFORM", by Martin E. Banton;

U.S. application Ser. No. 11/363,378, filed Feb. 27, 2006, entitled "SYSTEM FOR MASKING PRINT DEFECTS", by Anderson, et al.;

U.S. application Ser. No. 11/399,100, filed Apr. 6, 2006, entitled "SYSTEMS AND METHODS TO MEASURE BANDING PRINT DEFECTS", by Peter Paul;

U.S. application Ser. No. 11/403,785, filed Apr. 13, 2006, entitled "MARKING ENGINE SELECTION", by Martin E. Banton et al.

BRIEF DESCRIPTION

A diverter assembly is provided for an associated printing system that includes an associated media pathway having an associated diversion point and associated first and second paths extending therefrom. The diverter assembly includes a first rotary member including a first axis and supportable along the associated media pathway for rotation about the first axis. A first rotational motion source is operatively connected to the first rotary member.

A printing system is provided that includes a sheet media source, a sheet media outlet and a marking engine operatively disposed between the sheet media source and the sheet media outlet. A media pathway interconnects the sheet media source, the sheet media outlet and the marking engine. The media pathway includes a first path portion, a diversion point disposed along the first path portion, and second and third path portions extending from the diversion point. A diverter assembly is disposed along the media pathway adjacent the diversion point. The diverter assembly includes a first rotary member supported for rotary motion along a first side of the first path portion of the media pathway. A first rotational motion source is operatively connected to the first rotary member. A control system is in communication with at least the marking engine and the first rotational motion source.

A method of transporting a sheet of media along a media pathway of a printing system is provided. The media pathway includes a first path portion, a diversion point disposed along the first path portion, and second and third path portions extending from along the diversion point. The method includes providing a diverter assembly disposed along the first path portion adjacent the diversion point. The diverter assembly includes a first rotary member and a first rotational motion source operatively connected to the first rotary member. The first rotary member includes a first axis and a first diverter surface eccentrically disposed relative to the first axis. The method also includes transporting first and second sheets of media along the first path portion toward the diversion point. The method further includes rotating the first rotary member between a first condition and a second condition. In the first condition, the first diverter surface at least partially blocks the second path portion and permits passage of sheet media along the third path portion. In the second condition, the first diverter surface is disposed at least partially outside the media pathway such that sheet media can be transported along the second path portion. The method also includes delivering the first sheet of media to the diversion point with the first rotary member in the first condition and permitting passage of the first sheet of media along the third path portion. The method further includes delivering the second sheet of media to the diversion point with the first rotary member in the second condition and diverting the second sheet of media along the second path portion.

DETAILED DESCRIPTION

The subject matter of the present disclosure is capable of broad use in a wide variety of applications and environments, including use in association with printing systems of any suitable type, kind and/or configuration. For example, the subject matter of the present disclosure can be used on printing systems embodied as desktop printers, stand-alone copiers, multi-function (e.g., print/copy/fax) machines, and/or production-oriented or high-speed publishing equipment. Additionally, such printing systems can utilize any suitable type or kind of marking process or substance, such as a xerographic process using toner or an inkjet process using liquid ink, for example. Furthermore, it will be appreciated that the subject matter of the present disclosure is particularly well suited for use in association with printing systems having high output capacity, such as production printing and publishing systems, for example. However, any reference herein to such specific application and/or use is merely exemplary.

Figure 1:
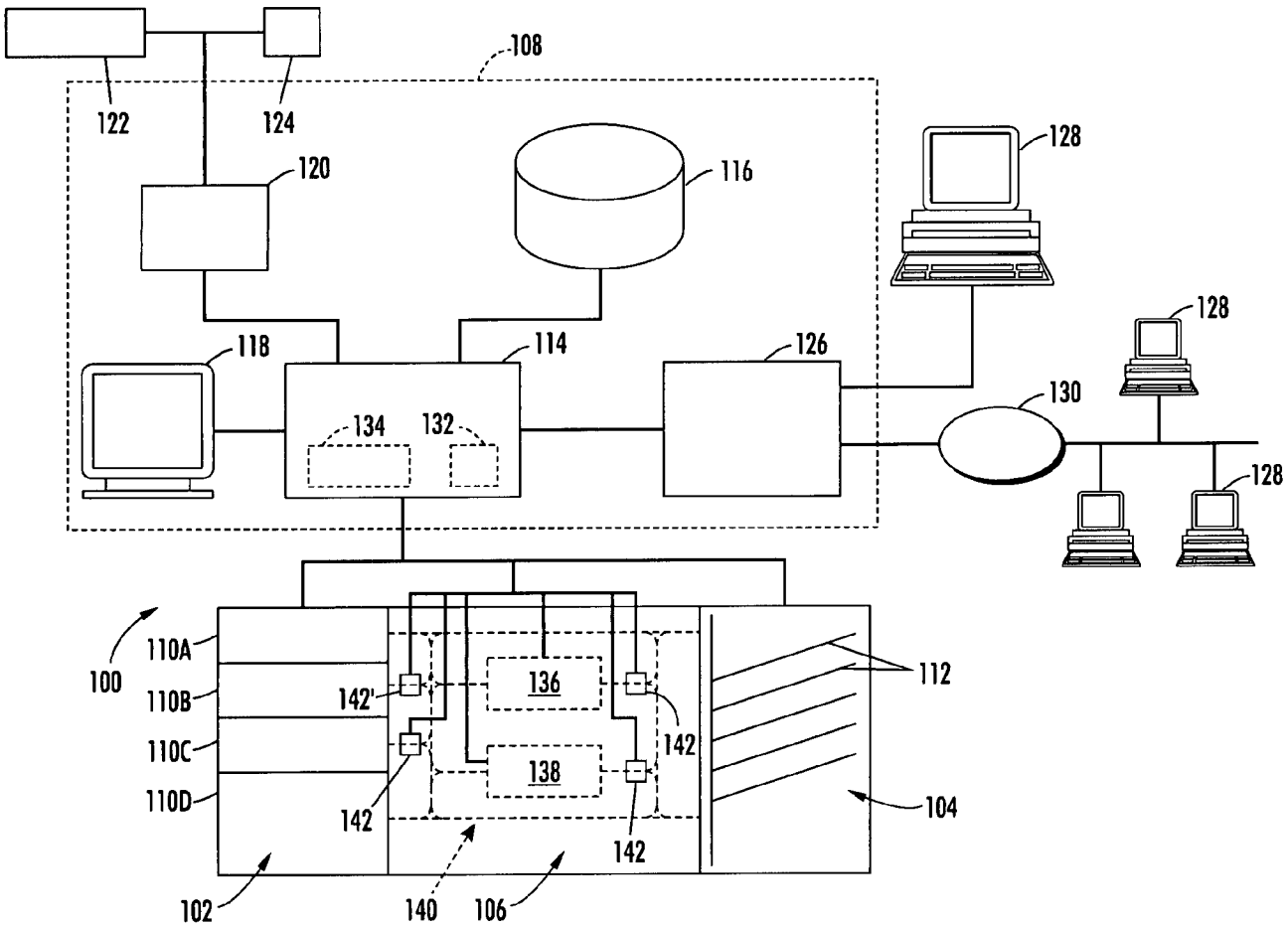
FIG. 1 is a schematic representation of one exemplary embodiment of a printing system according to the present disclosure.

Turning now to the drawings wherein the showings are for the purpose of illustrating exemplary embodiments and not intended as a limitation, FIG. 1 illustrates a printing system 100 that includes a sheet media source, such as a multi-drawer media supply 102, for example, a sheet media output, such as a finishing unit 104, for example, and a printing or marking unit, such as a marking system 106, for example, operatively disposed therebetween.

The printing system includes a suitable control system that is in communication with the various components and systems of the printing system and is adapted to coordinate operation of the same. In the exemplary embodiment shown, a control system 108 is in communication with media supply 102, finishing unit 104 and marking system 106.

Media supply 102 includes a plurality of sheet media storage drawers 110A-110D that are suitable for supplying individual sheets of media in a conventional manner. Finishing unit 104 can include one or more output trays 112 and can optionally be adapted for performing finishing operations, such as sorting, collating, stapling, hole punching and binding, for example, as are well known by those of skill in the art.

Control system 108 includes a controller 114 in communication with a storage device, such as a hard disk 116, for example, suitable for storing data, images and/or other information. A user interface, such as a display 118, for example, is also in communication with controller 114. Display 118 can optionally be adapted for touch-screen inputs, or an optional mouse, keyboard and/or other input device can alternately, or additionally, be included. An input interface, such as interface 120, for example, can optionally be included for communicating with one or more input devices, such as a raster output scanning system 122 and/or a memory card reader 124, for example. Control system 108 can also optionally include a communication interface, such as network interface 126, for example, for communicating with external computational devices 128 (e.g., personal computers, workstations, servers), either directly or through a suitable network 130. Controller 114 can be of any suitable type, kind and/or configuration, and can optionally include a processing device, such as a microprocessor 132, for example, and/or a memory, such as a non-volatile memory 134, for example.

A marking unit can include any number of marking engines, such as from 1 to 20 marking engines, for example, in any suitable arrangement or configuration, such as a plurality of marking engines disposed in a successive arrangement and suitable for operation in series with one another, for example. However, it will be appreciated that any suitable arrangement or configuration of marking engines can alternately be used. In the exemplary embodiment shown, marking system 106 includes two marking engines 136 and 138 that disposed in a parallel-processing type arrangement.

Generally, a marking unit will also include a media transport pathway that operatively connects the one or more marking engines between the sheet media source and the sheet media output. In the exemplary embodiment shown, a media transport pathway 140 operatively connects marking engines 136 and 138 between media supply 102 and finishing unit 104. Typically, a media transport pathway, such as pathway 140, for example, will generally include a plurality of paths or path portions that are suitable for transporting sheet media in a manner well known by those of skill in the art, and such paths or path portions converge and diverge in a typical manner at or along numerous intersections formed therebetween. Typically, a suitable gating arrangement of a conventional construction and/or operation is provided adjacent these intersections. However, a printing system according to the subject disclosure, such as printing system 100, for example, includes at least one diverter assembly, such as a diverter assembly 142 or 142', for example, disposed in operative association with at least one of the intersections. A diverter assembly, such as one of diverter assemblies 142 and 142', for example, is operative to selectively direct sheet media through the associated intersection.

Controller 114 of control system 108 is in communication with marking engines 136 and 138 and can operatively control the same in any suitable manner. Controller 114 is also in communication with at least one diverter assembly, such as diverter assembly 142 or 142', for example, for selectively operating the same, as is discussed in greater detail hereinafter.

The media transport pathway is in communication with the sheet media source and receives individual sheets of media therefrom. As can be more clearly seen in the exemplary embodiment shown in FIG. 2, media transport pathway 140 includes one or more input path portions, such as input path portions 144A-D, for example, that are disposed in operative association with storage compartments of the media supply, such as storage drawers 110A-D of media supply 102, for example. Input path portions 144A-D are in communication with a first, generally vertical transport pathway 146 that can include one or more path portions 146A-D operatively disposed between input path portions 144A-D. First and second generally horizontal transport pathways 148 and 150 extend from along the first vertical pathway toward a second, generally vertical transport pathway 152 that can include one or more path portions 152A-C. Media transport pathway 140 also includes one or more output path portions, such as output path portions 154A and 154B, for example, that are in operative association with a sheet media output, such as finishing station 104, for example.

Marking engines 136 and 138 are shown in the present exemplary embodiment as being operatively disposed between vertical transport pathways 146 and 152 with first marking path portions 156A and 158A extending from first vertical pathway 146 respectively toward marking engines 136 and 138. Second marking path portions 156B and 158B respectively extend from marking engines 136 and 138 toward second vertical pathway 152.

The media transport pathway also includes one or more diversion points at which three or more paths or path portions generally intersect. In the embodiment shown, media transport pathway 140 includes numerous "three-way" diversion points 160 at which three paths or path portions intersect as well as one "four-way" diversion point 162 at which four paths or path portions intersect. In the exemplary embodiment shown, a diverter assembly, such as one of diverter assemblies 142 or 142', for example, is disposed in operative association along several of the diversion points of the media transport pathway, such as diversion points 160 or 162, for example. In the disclosed arrangement, diverter assemblies 142 are respectively disposed along diversion points 160A-C, and diverter assembly 142' is disposed along diversion point 162. However, it will be recognized that other arrangements or configurations could alternately be used at or along a diversion point, such as diversion point 162, for example. One example of such an alternate arrangement could include two or more diverter assemblies, such as a diverter assembly 142, for example, that are arranged and used in a cascading or series configuration to distribute sheet media along three or more downstream paths or path portions, such as path portions 146A, 146B and 156A, for example. Traditional gates or other arrangements can optionally be disposed along the remaining diversion points or in any other suitable manner.

Figure 2:
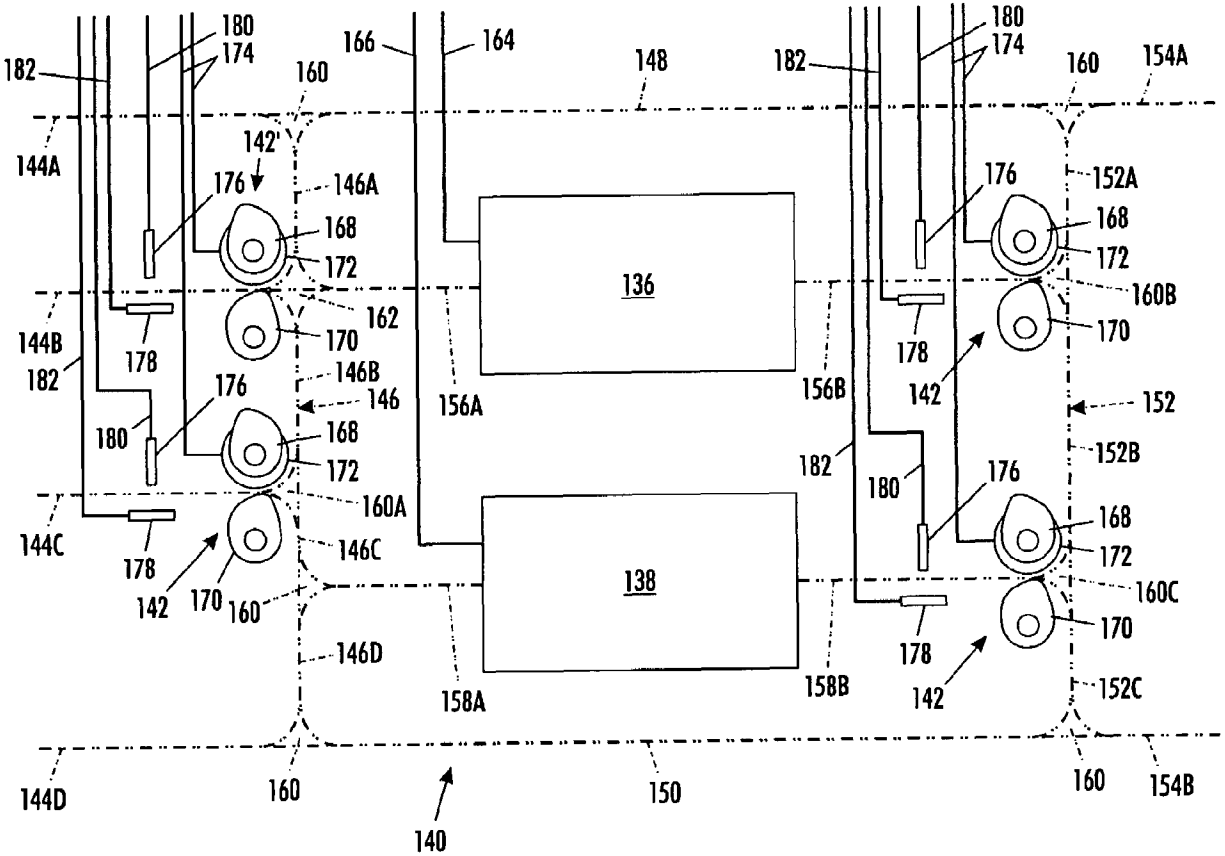
FIG. 2 is an enlarged schematic representation of the media pathways of the printing system in FIG. 1.

As shown in FIGS. 1 and 2, marking engines 136 and 138 are in communication with a component of control system 108, such as controller 114, for example, through suitable connections, such as leads 164 and 166, for example. A diverter assembly according to the present disclosure includes at least one rotary diverter member and a rotational motion source operatively associated with the at least one rotary diverter member. It will be appreciated, however, that diverter assemblies 142 and 142' include first and second rotary diverter members 168 and 170. Additionally, the diverter assemblies include a rotational motion source that is operatively associated with at least one of the rotary diverter members. As an example, the rotational motion source could be a motor or drive component (e.g., gear, shaft or belt) operatively associated with sheet media transporting or with a motive component of a marking engine. As another example, the rotational motion source could take the form of a separate motor, such as an electric motor 172, for example, that is in communication with a component of control system 108, such as controller 114, for example, through a suitable connection, such as lead 174, for example. The diverter assemblies can further include one or more sensors or sensing devices, such as sensors 176 and 178, for example, that are in communication with a component of control system 108, such as controller 114, for example, through suitable connections, such as leads 180 and 182, for example.

Figure 3:
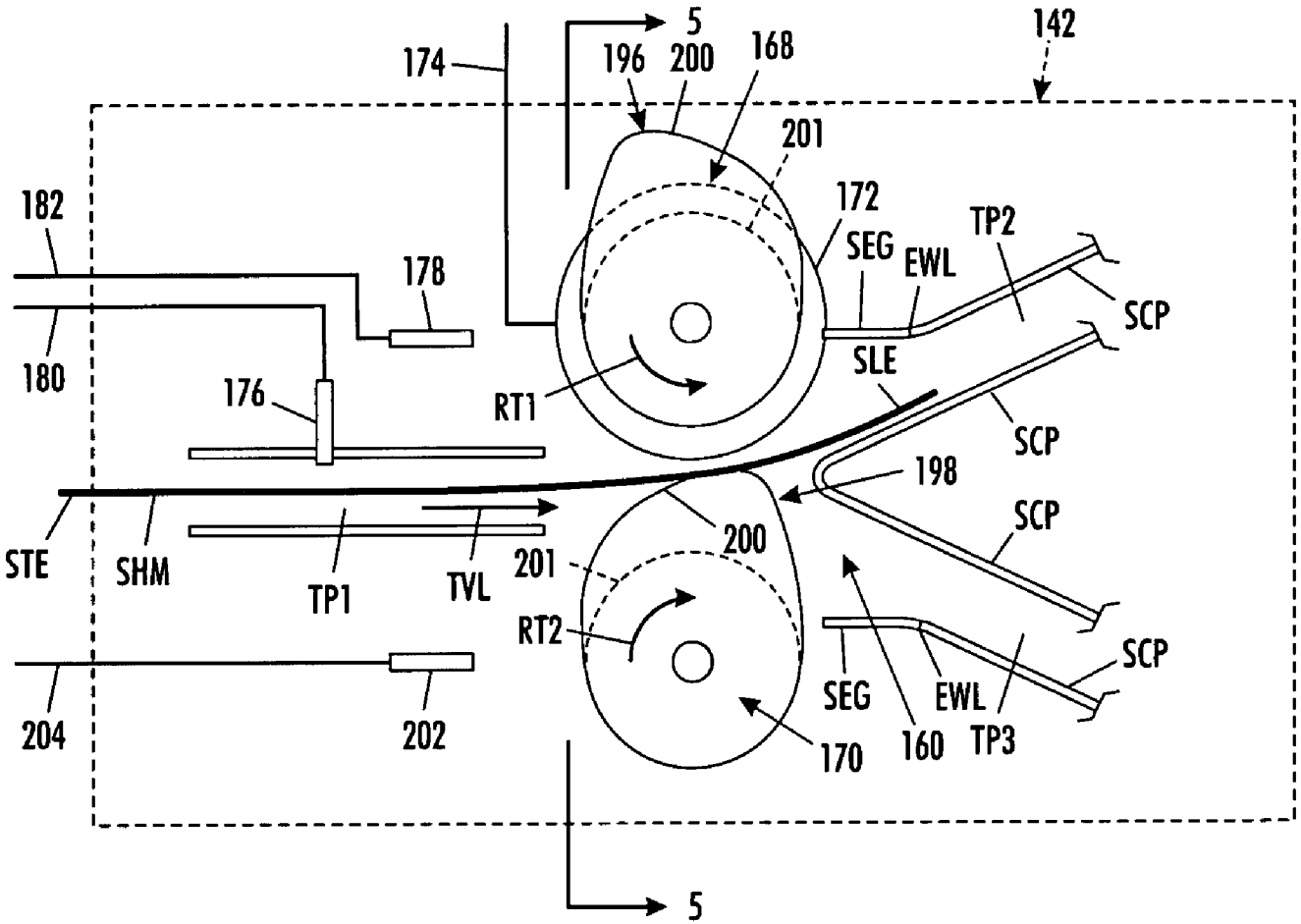
FIG. 3 is a side view of one embodiment of a diverter assembly in accordance with the present disclosure shown in operative association with a media pathway.
Figure 4:
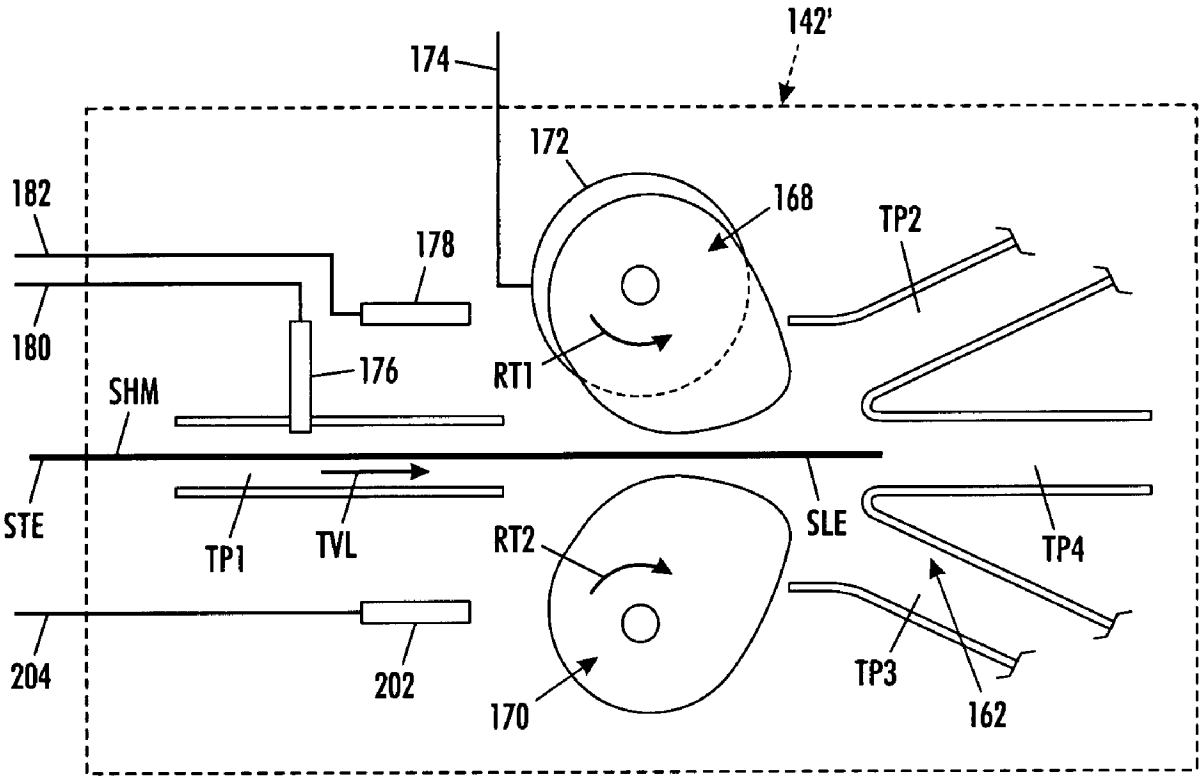
FIG. 4 is side view of the diverter assembly in FIG. 3 shown in operative association with an alternate media pathway.
Figure 5:
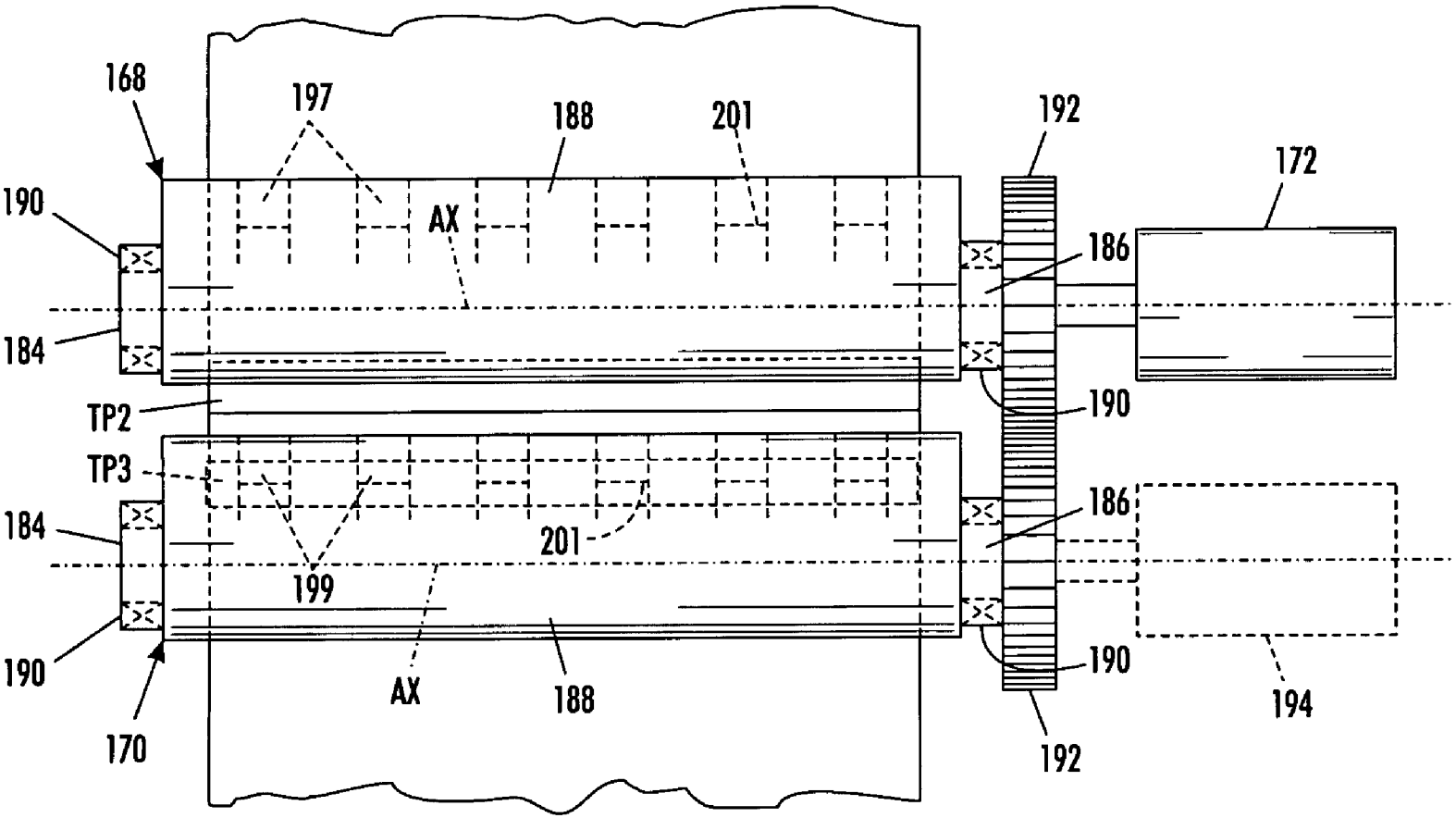
FIG. 5 is a rear view of the diverter assembly in FIG. 3 taken along line 5-5 thereof.

FIGS. 3-5 illustrate diverter assemblies 142 and 142' in additional detail. Diverter assembly 142 in FIG. 3 is disposed along a first media transport path or path portion TP1, such as path portions 144C, 156B or 158B, for example, adjacent a diversion point, such as a "three-way" diversion point 160, for example, that is provided therealong. Diverter assembly 142 is operative to direct or otherwise allow the passage of a sheet of media, which is being transported along first path portion TP1, along one of two or more transport paths or path portions. For example, second and third media transport paths or path portions TP2 and TP3, such as path portions 146B and 146C, path portions 152A and 152B, or path portions 152B and 152C, for example, are shown extending from along diversion point 160. A sheet of media SHM includes a sheet leading edge SLE and a sheet trailing edge STE, and is shown disposed along first and second transport path portions TP1 and TP2 such that the sheet leading edge is entering second path portion TP2.

Diverter assembly 142' in FIG. 4 is substantially similar to diverter assembly 142. However, diverter assembly 142' is disposed along a first media transport path or path portion TP1, such as path portion 144B, for example, adjacent a diversion point, such as a "four-way" diversion point 162, for example, that is provided therealong. Diverter assembly 142' is operative to direct or otherwise allow the passage of a sheet of media along three or more transport paths or path portions. For example, second, third and fourth path portions TP2, TP3 and TP4, such as path portions 146A, 146B and 156A, for example, extend from along diversion point 162. Sheet of media SHM is shown disposed along the first and fourth transport path portions such that sheet leading edge SLE is entering fourth path portion TP4.

As indicated above, diverter assemblies 142 and 142' are substantially similar and include first and second rotary members 168 and 170 that are supported for rotation along first path portion TP1 adjacent the diversion point. As shown in FIG. 5, rotary members 168 and 170 each include an axis AX, about which the respective members are rotated. The rotary members each include a first bearing portion 184, a second bearing portion 186 spaced from the first bearing portion, and a body portion 188 disposed therebetween. The rotary members can be formed from any suitable material or combination of materials, such as metal, rubber and/or plastic, for example, and are preferably supported for reduced frictional rotation, such as on or along suitable friction-minimizing components and/or using friction-reducing arrangements. As one example, bearings 190 can be provided along bearing portions 184 and 186.

As discussed above, a rotational motion source, such as electric motor 172, for example, can be operatively associated with the first and second rotary members in any suitable manner. In the exemplary embodiment shown, motor 172 directly drives first rotary member 168. Additionally, a suitable transmission arrangement or assembly, such as interengaging gears 192 (FIG. 5), for example, can be used to transmit rotary motion from first rotary member 168 to second rotary member 170. It will be appreciated, however, that any suitable arrangement could alternately be used. For example, a second rotational motion source, such as a second electric motor 194, for example, could directly drive second rotary member 170, rather than transmitting rotational and/or torsional input through a transmission, such as gears 192. In the embodiment shown, first and second rotary members 168 and 170 rotate in opposing directions, as indicated by arrows RT1 and RT2, and preferably rotate in the direction of travel of sheet of media SHM, as indicated by arrow TVL.

First and second rotary members 168 and 170 each respectively include a lobe portion 196 and 198 that is formed along body portion 188 thereof and is eccentrically disposed relative to axis AX for rotation thereabout. Each lobe portion includes a diverter surface 200 disposed therealong that is operative to deflect or divert a passing sheet of media. It will be appreciated that the lobe portions and diverter surfaces can take any suitable form, shape and/or configuration, and that the embodiments shown are merely exemplary. Additionally, it will be appreciated that rotary diverter members can include any suitable number of lobe portions or other similar features. For example, body portions 188 of rotary members 168 and 170 could include multiple lobe portions, such that a full rotation of the rotary members causes two or more lobes on each rotary member to pass into and/or out of the media transport path, such as along first path portion TP1, for example.

Furthermore, one or more of the rotary members, such as rotary members 168 and 170, for example, can optionally include discontinuities formed therealong, such as along body portions 188 thereof, for example. For example, body portions 188 can include openings or gaps 197 and 199 respectively formed through lobe portions 196 and 198. It will be appreciated, however, that such openings, gaps or other segmenting features can be of any suitable size, shape, form and/or configuration, and can be of any suitable number and/or spacing. In the exemplary embodiment shown, gaps 197 and 199 are formed through the lobe portions of the elongated body portions and have a bottom wall 201 formed at approximately the root or base diameter of the body portions. However, any other suitable arrangement or configuration can alternately be used.

Further still, at least a part of one or more of the structural components that form or otherwise at least partially define the paths or path portions can optionally include corresponding openings, gaps or other segmenting features complimentary to any such features provided on or along one or more of the rotary members. For example, structural components SCP in FIG. 3 are shown as including openings or gaps (not shown) formed by gap end walls EWL. Such an arrangement will permit the rotary members to be positioned more closely to the structural components of the paths. As such, gaps 197 and 199 are shown as being disposed in approximate alignment with one another. However, it will be appreciated that an offset or staggered alignment could alternately, or additionally, be used. In such an arrangement, the rotary members could be spaced more closely together. It will be appreciated that in such an arrangement, the openings or gaps formed along the structural component associated with each rotary member will be staggered such that the segments from the rotary member can project into the openings or gaps in the structural member, and vice versa. As a result, however, the openings or gaps of adjacent structural members could optionally be staggered relative to one another.

Turning now to an exemplary method of operation of a diverter assembly, such as diverter assembly 142 or 142', for example, the method can include generating rotational motion from a rotational motion source, such as electric motor 172, for example, and inputting the rotational motion into at least one rotary member, such as first rotary member 168, for example. It will be recognized that the application of rotational motion to the at least one rotary member causes the lobe portion formed along the body portion to rotate into and out of the media transport pathway, such as along first path portion TP1, for example. Due to the geometric configuration of the lobe portion and the diverter surface thereof, the body portion of the rotary member at least partially blocks one or more of the paths or path portions, such as one of second and third path portions TP2 and TP3, for example, extending outwardly (e.g., downstream) from the diversion point. Thus, the method can include rotating or otherwise displacing at least one rotary member is displaced between a first condition (FIG. 3) in which the diverter surface of the lobe portion is exposed along a first path or path portion and the lobe portion also at least partially blocks at least a second path or path portion, and a second condition (not shown) in which at least a part of the lobe portion is located outside the first path or path portion permitting the passage of a sheet of media toward a third path or path portion. Therefore, a full rotation of a rotary member displaces the same between the first and second conditions. Accordingly, continuous rotation of the rotary member would alternately direct a sheet of media along the second path and permit passage of a sheet of media along the third path. Such an arrangement would be well suited for use along a media transport pathway in which the third path is a continuation of the first path, such as in an approximately straight direction, for example, but in which the second path extends in a different direction from that of the first and third paths.

In another exemplary method of operation, two rotary members are used, such as rotary members 168 and 170, for example. The rotary members are also rotated between the first and second conditions, as described above. However, to avoid any potential interference between the lobe portions, the rotary members can be disposed out of phase with one another according to the relation PA=360/(2*N), where PA is the phase angle in degrees and N is the number of lobes on the rotary members. In the exemplary embodiment shown, each rotary member includes one lobe portion, so the phase angle between the two rotary members is approximately 180 degrees. That is, when one of the rotary members is in the first condition, the second rotary member is disposed in the second condition. Accordingly, continuous rotation of rotary members 168 and 170 will alternately direct sheets of media along the third path portion and the second path portion as the first and second rotary members alternately move between the first and second conditions.

One arrangement that is suitable for maintaining the substantially fixed phase relationship between the first and second rotary members is to directly drive one rotary member from the other, such as by using gears 192, for example. In an alternate arrangement, independent rotational motion sources, such as electronically controlled motors 172 and 194, for example, can be operatively associated with the rotary members and can individually control the motion of the same. Additionally, an arrangement in which the rotary members are individually controlled will also permit usage of the rotary diverter members in other phase angle relations. For example, an arrangement such as that shown in FIG. 4 could be achieved with individually controlled rotary members. In such a configuration, first rotary member 168 at least partially blocks second path portion TP2 and second rotary member 170 at least partially blocks third path portion TP3. However, each of the rotary members is rotated such that the lobe portions thereof are advanced somewhat from the first condition. As such, a gap or opening (not numbered) between the rotary members is formed that permits the passage of a sheet of media into and along fourth path portion TP4 while at least partially blocking the second and third path portions to prevent a sheet of media from inadvertently entering the same.

A sensor or sensing device, such as sensor 176, for example, is provided along first path portion TP1 is operative to generate a signal indicative of a position of a sheet of media. In one example, sensor 176 can operate to determine when leading edge SLE of sheet SHM reaches the sensor. Based upon the position of the sensor relative to the rotary members and the speed of travel of the sheet of media along the first transport path, controller 114 or another suitable component or system can determine and/or adjust the proper timing and/or rotational speed of the rotary members such that the diverter surface thereof is in an appropriate position as the leading edge of the sheet of media reaches the associated diversion point.

However, it will be appreciated that to properly time the arrival of the leading edge of a sheet of media with the arrival of the diverter surface that is physically contacted by the leading edge of the sheet, it will often be desirable to provide a signal indicative of the position of one or more of the rotary members. This can be done in any suitable manner, such as by providing a rotary encoder (not shown) operatively associated with the rotational motion source, for example. As another example, sensor 178 can be provided adjacent one of the rotary members, such as rotary member 168, for example. Sensor 178 can be operative to generate a signal indicative of when the lobe portion of the rotary member is in proximal relation to the sensor. Thus, sensor 178 can operate to locate the lobe portion of the rotary member, such as during start-up or intermittently during operation of the printing system, for example.

Additionally, if diverter assembly 142 or 142' utilizes two independent rotational motion sources, as discussed above, for example, a third sensor 202 can optionally be provided. Third sensor 202 is in communication with a component of control system 108, such as controller 114, for example, through a suitable connector, such as a lead 204, for example. Sensor 202 is operative to output a signal indicative of a position of a second rotary member, such as rotary member 170, for example. For example, sensor 202 can be operative to generate a signal indicative of when the lobe portion of rotary member 170 is in proximal relation to the sensor, such as has been discussed above with regard to sensor 178 and rotary member 168, for example.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A diverter assembly for an associated printing system including an associated controller and an associated media pathway having an associated diversion point and associated first and second paths extending therefrom, said diverter assembly comprising:

a first rotary member including a first longitudinal axis and a first diverter surface eccentric to said first longitudinal axis, said first rotary member supported along one side of the associated media pathway such that said first longitudinal axis is disposed approximately transverse to the associated media pathway, and said first rotary member rotatable about said first longitudinal axis such that upon full rotation of said first rotary member about said first longitudinal axis said first diverter surface extends into the associated media pathway and is retracted out of the associated media pathway at least once;

a second rotary member including a second longitudinal axis and a second diverter surface eccentric to said second longitudinal axis, said second rotary member supported along an opposing side of the associated media pathway from said first rotary member such that said second longitudinal axis is disposed approximately transverse to the associated media pathway, and said second rotary member rotatable about said second longitudinal axis such that upon full rotation of said second rotary member about said second longitudinal axis said second diverter surface extends into the associated media pathway and is retracted out of the associated media pathway at least once;

a first rotational motion source in electrical communication with the associated controller and connected to said first rotary member; and, a second rotational motion source in electrical communication with the associated controller and connected to said second rotary member for;

said first and second rotational motion sources operating in:

a first mode in which said first and second rotary members are continuously and synchronously rotated through full rotations about said first and second longitudinal axes during which rotation said first and second diverter surfaces are oriented in and substantially maintained at a first rotational phase angle relative to one another; and, a second mode in which said first and second rotary members are asynchronously rotated about said first and second longitudinal axes during which rotation said first and second diverter surfaces are oriented in a second rotational phase angle relative to one another that is different than said first rotational phase angle and in which at least a portion of each of said first and second diverter surfaces extend into and are maintained within the associated media pathwav such that a gap is maintained within the associated media between the first and second diverter surfaces.

2. A diverter assembly according to claim 1, wherein said first rotary member includes a first bearing surface and a second bearing surface spaced longitudinally from said first bearing surface with said first diverter surface disposed between said first and second bearing surfaces.

3. A diverter assembly according to claim 2, wherein said second rotary member includes a third bearing surface and a fourth bearing surface spaced longitudinally from said third bearing surface with said second diverter surface disposed between said third and fourth bearing surfaces.

4. A diverter assembly according to claim 3, wherein said first and second bearing surfaces of said first rotary member extend approximately coaxially with said first longitudinal axis and said third and fourth bearing surfaces of said second rotary member extend approximately coaxially with said second longitudinal axis.

5. A diverter assembly according to claim 3, wherein said first rotary member includes a first body portion longitudinally extending between said first and second bearing surfaces with said first diverter surface disposed along said first body portion, said second rotary member includes a second body portion longitudinally extending between said third and fourth bearing surfaces with said second diverter surface disposed along said second body portion, said first and second body portions each including one or more longitudinally extending gaps formed therealong that respectively segment said first diverter surface and said second diverter surface.

6. A diverter assembly according to claim 5, wherein said first and second rotary members are positioned such that said one or more longitudinally extending gaps of said first body portion are disposed in one of an approximately aligned relation and a staggered relation to said one or more longitudinally extending gaps of said second body portion.

7. A diverter assembly according to claim 1, wherein said first and second rotational motion sources each include an electric motor.

8. A printing system comprising:

a sheet media source;

a sheet media outlet;

a marking engine operatively disposed between said sheet media source and said sheet media outlet;

a media pathway interconnecting said sheet media source, said sheet media outlet and said marking engine, said media pathway including:

a first path portion;

a diversion point disposed along said first path portion;

second and third path portions in communication with said first path portion and extending from said diversion point in outward relation to one another; and, a fourth path portion in communication with said first path portion and extending from said diversion point between said second and third path portions;

a first rotary member including a first axis and a first diverter surface eccentric to said first axis, said first rotary member supported along a first side of said first path portion of said media pathway adjacent said diversion point and rotatable about said first axis such that upon full rotation of said first rotary member about said first axis said first diverter surface extends into the first path portion and is retracted out of the first path portion at least once;

a second rotary member including a second axis and a second diverter surface eccentric to said second axis, said second rotary member supported along an opposing second side of said first path portion of said media pathway in laterally-spaced relation to said first rotary member and rotatable about said second axis such that upon full rotation of said second rotary member about said second axis said second diverter surface extends into the first path portion and is retracted out of the first path portion at least once;

a first rotational motion source operatively connected to said first rotary member that rotates said first rotary member about said first axis;

a second rotational motion source operatively connected to said second rotary member that rotates said second rotary member about said second axis; and, a control system in communication with at least said marking engine, said first rotational motion source and said second rotational motion source, said control system operating said first and second rotational motion sources in a first mode and a second mode such that:

1) in said first mode, said first and second rotary members are fully and substantially continuously rotated by said first and second rotational motion sources with said first and second rotary members oriented in a first rotational phase relative to one another, and during said full and substantially continuous rotation in said first mode said first and second rotary members alternating between a first condition in which said third and fourth path portions are at least partially blocked and a second condition in which said second and fourth path portions are at least partially blocked; and, 2) in said second mode, at least one of said first and second rotary members is rotated by said first and second rotational motion sources through less than a full rotation and into a second rotational phase relative to one another that is different from said first rotational phase and in which at least a portion of said first and second diverter surfaces extend into and are maintained within said media pathway such that said second and third path portions are at least partially blocked and associated sheets of media are directed into said fourth path portion.

9. A printing system according to claim 8, wherein said media pathway includes a structural component at least partially defining one of said first, second, third and fourth path portions, said structural component including at least one gap forming at least one segment, and said first rotary member including a first body portion with said first diverter surface disposed therealong, said first body portion including at least one gap forming at least one segment cooperative with said at least one gap of said structural component.

10. A printing system according to claim 9, wherein said second rotary member includes a second body portion with said second diverter surface disposed therealong, said second body portion including at least one gap forming at least one segment cooperative with said at least one gap of said structural component.

11. A printing system according to claim 10, wherein said first and second rotary members are positioned such that said at least one gap of said first and second body portions are disposed in one of an approximately aligned relation and a staggered relation.

12. A printing system according to claim 8 further comprising a first sensor in communication with said control system and operative to generate a signal indicative of an orientation of said first rotary member.

13. A printing system according to claim 12, wherein said first sensor is a proximity sensor disposed adjacent said first rotary member and operative to generate said sensor signal when said first diverter surface is disposed in proximate relation to said first sensor.

14. A printing system according to claim 12 further comprising a second sensor in communication with said control system and operative to generate a signal indicative of an orientation of said second rotary member.

15. A printing system according to claim 14, wherein said second sensor is a proximity sensor disposed adjacent said second rotary member and operative to generate said sensor signal when said second diverter surface is disposed in proximate relation to said first sensor.

16. A printing system according to claim 14, wherein said control system is adapted to orient said first and second rotary members from said second rotational phase to said first rotational phase using at least said first and second sensors.

17. A method of transporting sheets of media along a media pathway of a printing system, the media pathway including a first path portion, a diversion point disposed along the first path portion, and second, third and fourth path portions extending from along the diversion point with the fourth path portion disposed between the second and third path portions, said method comprising:

a) providing first and second rotary members, supporting said first rotary member for rotational operation along one side of the first path portion adjacent the diversion point and supporting said second rotary member for rotational operation along an opposing side of the first path portion in spaced relation to the first rotary member, said first rotary member including a first axis and a first diverter surface eccentrically disposed relative to said first axis, said second rotary member including a second axis and a second diverter surface eccentrically disposed relative to said second axis;

b) providing first and second rotational motion sources, said first rotational motion source connected with said first rotary member, and said second rotational motion source connected with said second rotary member;

c) operating said printing system in a first mode that includes:

c1) orienting said first and second rotary members relative to one another into a first phase relationship using at least one of said first and second rotational motion sources; and c2) rotating said first and second rotary members through a plurality of full rotations in a substantially synchronous manner such that said first phase relationship is substantially maintained therethrough and such that during said plurality of full rotations said first and second rotary members reach:

a first condition in which said first diverter surface at least partially blocks the second and fourth path portions and said second diverter surface is retracted from the media pathway which permits passage of sheet media along the third path portion; and, a second condition in which said second diverter surface at least partially blocks the third and fourth path portions and said first diverter surface is retracted from the media pathway which permits passage of sheet media along the second path portion; and, d) operating said printing system in a second mode that includes orienting said first and second rotary members relative to one another in an asynchronous manner into a second phase relationship that is different than said first phase relationship using at least one of said first and second rotational motion sources such that in said second phase relationship at least a portion of said first and second diverter surfaces of said first and second rotary members extend into the media pathway and at least partially block the second and third path portions which permits passage of sheet media along the fourth path portion.

18. A method according to claim 17, wherein a) includes providing a sensor in operative association with said first rotary member for generating a sensor signal having a relation to a rotational orientation of said first diverter surface, and orienting said first and second rotary members in d) includes orienting at least said first rotary member based at least partially on said sensor signal from said sensor.

19. A method according to claim 18, wherein a) includes providing a second sensor in operative association with said second rotary member for generating a sensor signal having a relation to a rotational orientation of said second diverter surface, and orienting said first and second rotary members in d) includes orienting said second rotary member based at least partially on said sensor signal from said second sensor.

20. A method according to claim 19, wherein orienting said first and second rotary members based on said sensor signals respectively from said first and second sensors includes rotating at least one of said first and second rotary members from said second phase relationship to said first phase relationship.

21. A method according to claim 17, wherein in said first condition said first and second rotary members are approximately 180 degrees angularly out of phase with one another, and c2) includes repeatedly rotating said first and second rotary member to alternately divert sheet media along the second and third path portions.

22. A method according to claim 21, wherein c2) includes selectively stopping rotation of said first and second rotary members in one of said first and second conditions to selectively direct multiple sheets of media along one of the second and third path portions.

* * * * *